United States Patent [19]

Kummerman

[11] 4,142,640

[45] Mar. 6, 1979

[54] DEVICE FOR RETRACTING OR EXTENDING A MOVABLE ACCESS RAMP

[75] Inventor: Henri Kummerman, Geneva, Switzerland

[73] Assignee: MacGregor International S.A., Basel, Switzerland

[21] Appl. No.: 862,424

[22] Filed: Dec. 20, 1977

[30] Foreign Application Priority Data

Dec. 29, 1976 [FR] France ..... 76 39424

[51] Int. Cl.[2] ..... B65G 67/58; B63B 27/14

[52] U.S. Cl. ..... 414/139; 14/71.3; 244/137 R

[58] Field of Search ..... 214/14, 12, 15 R; 114/72, 73, 258; 14/71.3; 105/447; 244/129.6, 137 R, 137 P

[56] References Cited

U.S. PATENT DOCUMENTS 3,933,256 1/1976 Fagerlund ..... 214/15 R

FOREIGN PATENT DOCUMENTS 1582090 9/1969 France ..... 214/13

*Primary Examiner*—Francis S. Husar
*Assistant Examiner*—George F. Abraham
*Attorney, Agent, or Firm*—Kenyon & Kenyon Reilly, Carr & Chapin

[57] ABSTRACT

The invention relates to device for retracting and extending a movable, vertically pivoting access ramp comprising at least two successive main sections. At least one intermediate interlinking member is hinged with the main sections of the ramp towards their adjacent ends about a first hinge pin and a second hinge pin, respectively. First operating means are provided for the rotation of one section of the ramp and the intermediate member about the first hinge pin and second operating means are provided for the rotation of the other section of the ramp about the second hinge pin.

12 Claims, 6 Drawing Figures

DEVICE FOR RETRACTING OR EXTENDING A MOVABLE ACCESS RAMP

The present invention relates generally to and has essentially for its object a device for retracting or extending a movable access ramp for use as an interconnecting path, passage-way, or bridging connection between, on the one hand, any kind of vehicle, especially a land vehicle or a marine vehicle such as more particularly a ship or like floating vessel and, on the other hand, a loading or unloading external platform surface such as a dock, quay, wharf, pier or the like.

The ship is equipped, usually astern or aft, with a ramp of the vertically pivoting type raisable to an inoperative and stowed position and the said vehicle and lowerable to an operative or working position wherein it partially rests upon a platform. The ramp is made up, for example, of at least two main successive sections hingedly interconnected end to end in the longitudinal direction, the first or innermost section being hingedly connected to the vehicle and attached at at least one location to at least one handling cable which is constantly in tension and is reeled onto at least one winch on the vehicle whereas the other or second section is downwardly foldable against and lengthwise of the said innermost section.

To extend or unfold a ramp of that type, the cables connected on the one hand to the innermost section and on the other hand to the handling winch on the ship are actuated to cause the ramp to pivot. Then, and generally simultaneously, the outermost ramp section has to be extended or unfolded so as to be moved to a position substantially in longitudinal prolongation of the innermost section. Use is generally made, to this end, of second cables or relative extension cables for hoisting the outermost section to an extended position in at least approximate prolongation of the innermost element in lowered working configuration.

The invention provides a new type of device for extending the outermost section, which does not require the use of additional cables and therefore results in a considerable simplification of the connection between the ramp and the ship while at the same time preserving the reliability and safety in operation of the prior devices.

The invention therefore has for its object a device for retracting or extending a movable access ramp between, for example, a vehicle such as a ship or like floating vessel and an external platform such as a dock, quay, wharf, pier or the like, the said ramp being movable vertically and hoistable to an inoperative and stowed position on the ship and lowerable to an operative or working position so as to partially rest on the platform and comprising at least two successive main sections, namely an innermost section hingedly connected to the ship and attached at at least one location to at least one handling cable adapted to be reeled for example onto at least one winch on the ship, and an outermost section foldable downwardly against and lengthwise of the said inner section, the said device being characterized in that it comprises at least one interlinking member hinged with the two main, innermost and outermost sections of the ramp towards their adjacent ends about a first hinge axis and a second hinge axis, respectively, substantially perpendicular to the longitudinal axis of the ramp, by at least first means for rotating the outermost section of the ramp and the interlinking member relative to the innermost section about the first hinge axis, and by at least second means for rotating the outermost section of the ramp relative to the interlinking member about the second hinge axis.

Other advantages, characterizing features and details of the invention will appear more clearly from the following explanatory description made with reference to the appended drawings given solely by way of example and wherein.

Figure 1:
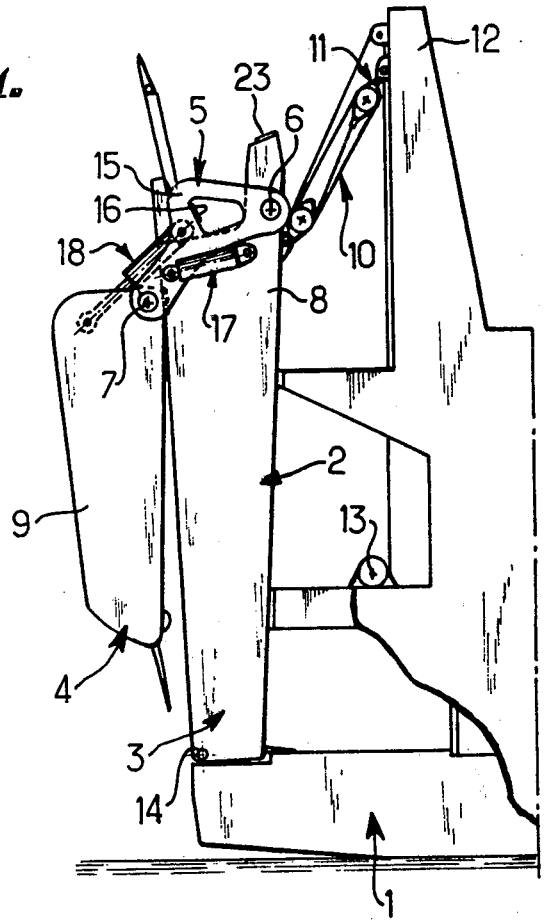
FIG. 1 is a longitudinal sectional view of a retractable movable access ramp in the retracted or folded position against the ship, according to a first form of embodiment.

A first form of embodiment of the invention is illustrated in FIGS. 1 to 4, where the reference numeral 1 generally designates a ship or like floating vessel, only the stern or aft end of which is shown. The ship's stern portion is provided with a movable access ramp 2 made up of two main successive sections, namely an innermost section 3 and an outermost section 4, respectively. The successive ramp sections 3, 4 are connected with one another by at least one interlinking or intermediate connection member 5 hinged with both ramp sections 3, 4 about two hinge pins 6, 7, respectively, to allow the two sections to be substantially aligned in prolongation of one another in the lowered position of the ramp.

The innermost section 3 and the outermost section 4 are each hinged with two longitudinal side-beams 8, 9, respectively. The innermost section 3 is preferably attached towards its end adjacent to the outermost section 4 to handling cables 10 adapted to be reeled, through the medium of hide pulleys 11, pivotally mounted on a post or the like 12 on the ship, onto a power-driven winch 13 placed for example on an upper deck of the ship 1. The main function of the cables 10 is to ensure the pivoting of the ramp 2 through the medium of its innermost section 3 which, to this end, is hinged with the stern of the ship 1 about a hinge pin 14 substantially perpendicular to the longitudinal axis of the ramp 2, whereas the pivoting of the outermost section 4 is independent of the handling cables 10.

There will now be described in detail the means for unfolding or folding the outermost section 4 relative to the innermost section 3, i.e. the means which are associated with the hinges 6, 7 between the interlinking member 5 and the two ramp sections 3, 4, respectively.

According to one form of the embodiment, the connection between the ramp sections 3, 4 is ensured by two interlinking or intermediate connecting members 5 mounted at either side of the adjacent ends of the two ramp sections and in parallel relationship to the latter. Each interlinking member 5 is made up, for example, of two parallel flat and slighty bent elements 15 mounted at either side of the longitudinal side-beams 8 and 9 of both sections 3, 4 of the ramp 2. The said two elements are interconnected in the region of their respective bends by a stop or abatment plate 16, the role of which will be explained later. The interlinking member 5 is hinged towards one of its ends with the innermost section 3 through the medium of the hinge pin 6 located towards substantially the free end of the associated longitudinal side-beam 8. The interlinking member 5 is also hinged at its other end with the outermost section 4 about the hinge pin 7, which is located towards substantially the associated end of the longitudinal side-beam 9, and with the lower portion of the latter.

With both hinged connections 6, 7 are associated two operating means 17, 18, respectively, consisting for example of two pneumatic or hydraulic power cylinders or actuators for each interlinking member. Each actuator 17 has a cylinder 19 hingedly connected to the associated side-beam 8 of the innermost section 3 and the free end of its rod 20 hinged with one of the plate elements 15 of the interlinking member. Each actuator 18 is mounted between the two plate elements 15 of an interlinking member 5 and has its cylinder 21 hinged with the interlinking member 5 whereas the free end of its rod 22 is hingedly connected to the side-beam 9 associated with the outermost section 4.

Reference is now made to the various Figures to describe the operation of a ramp such as 2 allowing a connection, passage-way or bridging to be provided between a ship 1 and a platform 24 such as a dock, quay, wharf or pier.

Figure 2:
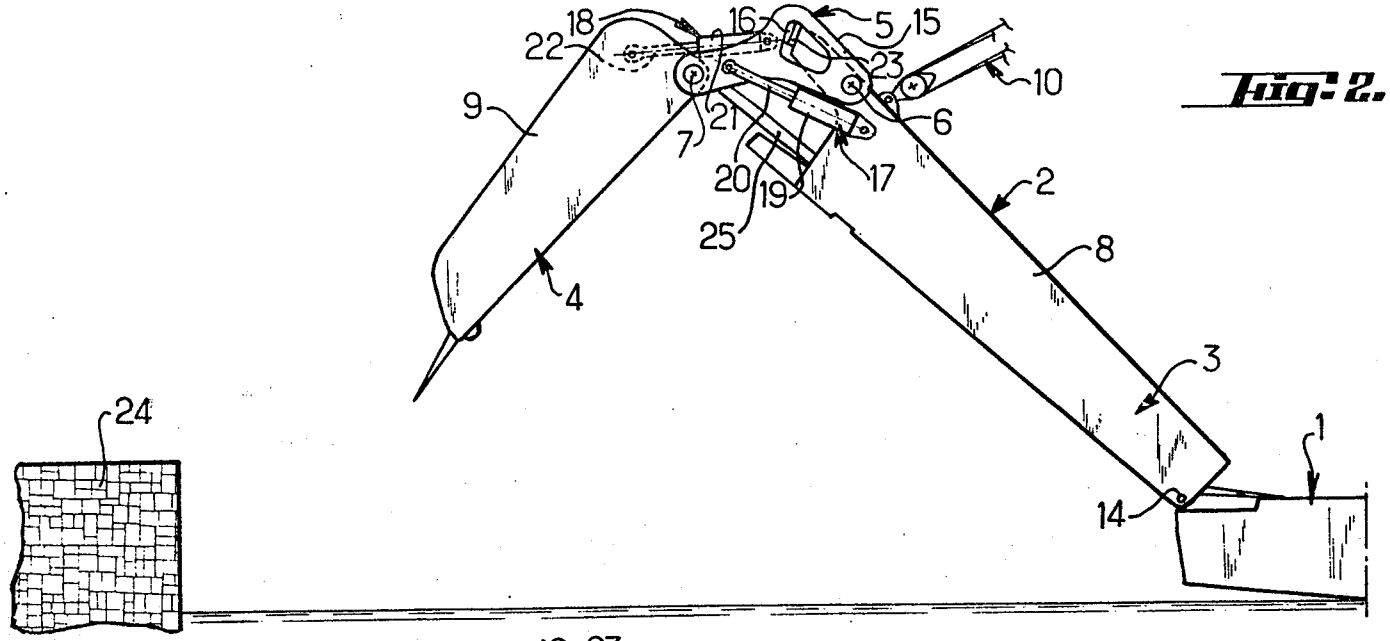
FIG. 2 is a longitudinal sectional view of the access ramp in the partially extended or unfolded position.
Figure 3:
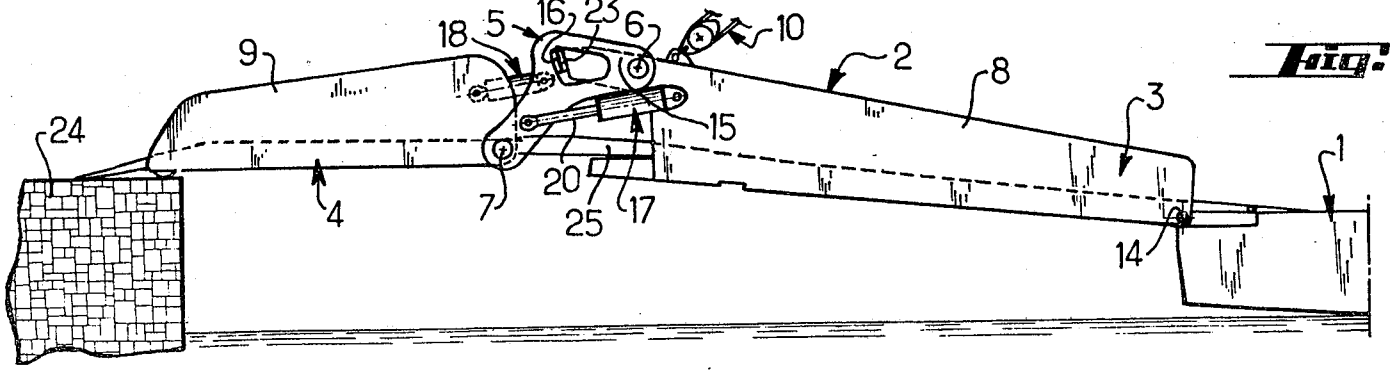
FIG. 3 is a longitudinal sectional view of the ramp in the completely extended or unfolded position between, for example, a ship and a dock.

Reference to FIGS. 1 to 3, the ramp 2 is assumed to be initially in the retracted and completely raised position shown in FIG. 1, with the ramp outermost section 4 folded under the innermost section 3. In order to lower the ramp 2 into working extended position, a locking system (not shown) allowing the ramp to be secured in that position is first unlocked, and then the winch 13 is operated in the paying out direction in order to relieve the tension on the handling cables 10, thus allowing the ramp 2 to pivot about its hinge pin 14 secured to the stern of the ship 1. It should be noted that in the initial position shown in FIG. 1 the rods of the actuator 17 associated with the hinged joint 6 are in retracted position, whereas the rods 22 of the actuators 18 associated with the hinged joint 7 are in extended position. Each interlinking member 5 is in such a position that each stop plate 16 is in the remote position relative to the corresponding end 23 of the side-beam 8 of the innermost section 3 of the ramp 2.

It is preferable, however, before operating the winch 13, to cause the actuators 17 to extended slightly so as to extend or unfold to a slight extent the outermost section 4 relative to the innermost section 3, thus allowing the center of gravity of the ramp 2 to be displaced beyond the hinge axis 14 (outwards of the ship) and therefore facilitating the pivoting of the ramp and avoiding the use of large thrust actuators on the ship for starting the pivoting motion of the ramp.

Referring to FIG. 2, as the ramp 2 is pivoting about the hinge pin 14 and is an intermediate position between the ship's stern and the dock 24, the actuators 17 are operated to ensure, in a first stage, the unfolding of the outermost section 4 relative to the innermost section 3 of the ramp. Indeed, under the action of the actuators 17, the ramp outermost section 4 pivots about the hinged joints 6, the interconnecting members 5 being driven in rotation together with respect to the innermost member 4 through the medium of the actuators 17.

After the actuators 17 have operated, the ramp is in the position shown in FIG. 2, and after this first rotation about the hinged joints 6, the plates 16 of the interlinking members 5 abut against the corresponding ends 23 of the longitudinal sidebeams 8 of the ramp outermost section 3. The stop plates 16 limit the travel of the rods 20 of actuators 17. In order to reach the extended position shown in FIG. 3 wherein the ramp 2 ensures the connection or bridging between the ship 1 and the pier 24, the whole ramp 2 has continued to pivot about the hinge pin 14 and the actuators 18 have been operated to move the ramp outermost section 4 to a substantially aligned position with and in prolongation of the innermost section 3 of the ramp 2. During this movement, the interlinking members 5 are connected rigidly by the actuators 17 to the innermost section of the ramp 2 and the actuators 18 ensure the rotation of the outermost section 4 relative to the innermost section 3 about the second hinged joints 7.

The actuators 18 may ensure the alignment of the ramp outermost section 4 with respect to the innermost section 3, but they may also vary the angle between the two ramp sections to take into account the relative height between the platform or dock 24 and the ship's loading deck.

In the form of embodiment just described, the two pivoting movements about the pivot pins 6 and 7 has been divided into two steps, but obviously the rotations about these joints may take place simultaneously.

Figure 4:
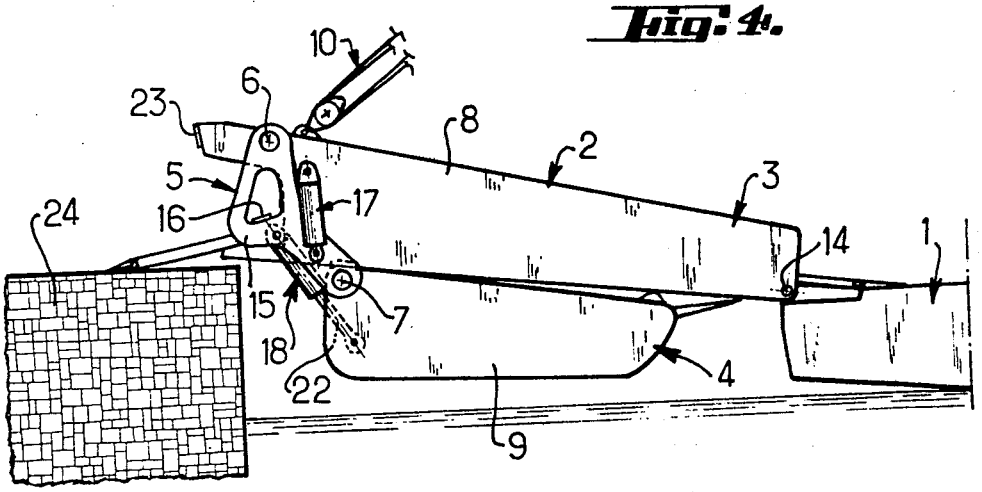
FIG. 4 is a longitudinal sectional view showing the ramp in the extended position, with the outermost section held folded lenghtwise of the innermost section which alone insures the connection between the ship and the dock.

Referring to FIG. 4, the ramp is shown in extended position between the ship 1 and the dock 24, but in this case the distance therebetween does not require the extension of the outermost section 4 relative to the innermost section 3. So, the extension of the ramp is performed only by means of the handling cables 10, whereas the outermost section 4 remains folded under the innermost section 3, that is to say the actuators 17 and 18 are not put into action.

In order to hoist the ramp 2, it is sufficient to perform the same operations as previously, but in the contrary sequence.

As can be observed particularly in FIGS. 2 and 3:

the rolling surface of the ramp innermost section is extended beyond the longitudinal side-beams 8 by a rolling platform 25 insuring the connection between the rolling surface of the outermost section 4 of the ramp, the stops 16 secured to the interlinking members 5 cooperate with the upper end surfaces of the side-beam 8 of the ramp innermost section 3. This cooperation limits the action of the first operating means 17 associated with the hinged joints 6, and is maintained only under the action of these means.

There are no drawbacks to this form of embodiment where the ramps are not excessively long.

If, on the contrary, the ramps are relatively long, problems of bending stress compensation arise when the ramp is in completely extended position, especially in the region of the intermediate members.

So, according to a second form of embodiment, the bending stresses are reduced by placing the stop elements at the lower portion of the innermost section.

Figure 5:
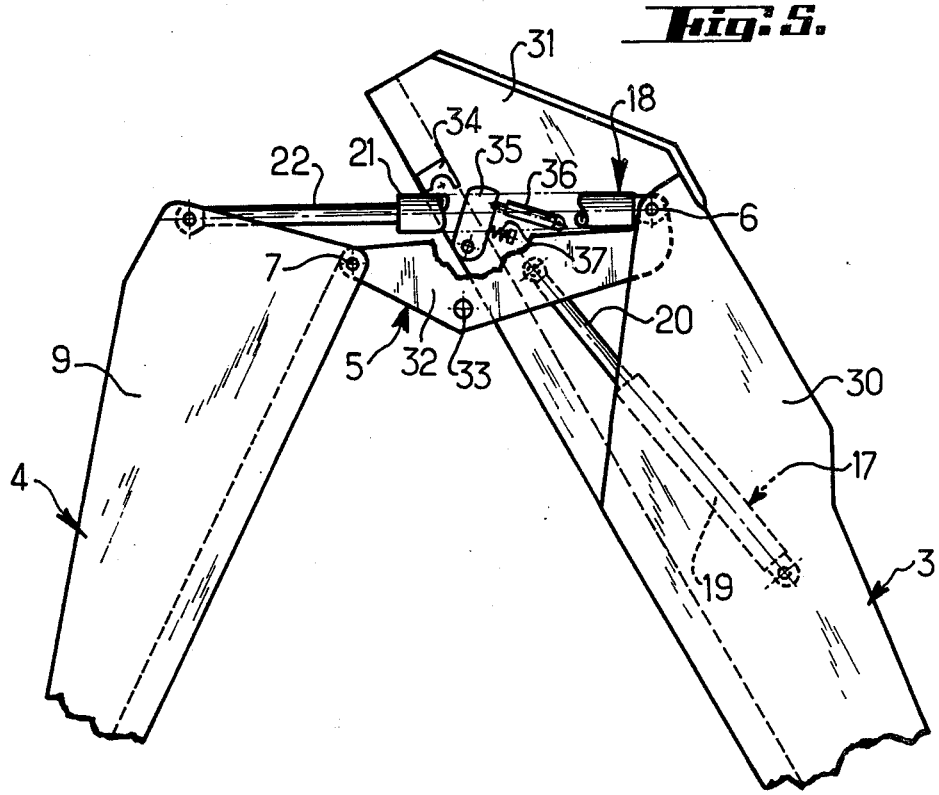
FIG. 5 is a partial longitudinal, partially broken-away view of a second form of embodiment of a retractable movable access ramp in an intermediate position during extension.

Therefore, referring to FIGS. 5 and 6, there will be described a preferred form of embodiment of the invention which differs from the first form of embodiment in the region of the intermediate members, of the stop elements and of the structure of the ramp innermost section end adjacent to the outermost section, the actuators operating in the same manner as in the first form of embodiment.

The innermost section 3 is provided along each edge with a first longitudinal side-beam 30 which extends over a portion of the rolling surface from the end adjacent to the ship 1, and with a second longitudinal beam 31 parallel with the beam 30 located internally of the ramp and which extends from the end of the innermost section 3 opposite to the ship 1 and substantially beyond the adjacent end of the beam 30.

As previously, the two ramp sections are connected on either side by an interlinking member 5 through the medium of two hinged joints 6, 7, respectively. Each interlinking member is made up for example of two parallel plates 32 spaced from one another, each in the form, for example, of a triangle with one angle greater than 90°. Towards these ends of the side opposite to this angle are provided two hinge pins 6, 7 secured to the innermost section 3 and to the outermost section 4, respectively. More precisely, the hinge pin 6 is supported by both side members 30, 31 in their mutual overlapping region and towards the upper portion thereof. The hinge pin 7 is supported by the end of the outermost section 4 towards the lower portion of the latter. In addition, the two plates 32 constituting each interlinking member are connected together through the medium of a pin 33 perpendicular to the said plates located in proximity to the obtuse angle of each plate 32, and projecting externally from the inner plate 32.

With both hinged joints 6, 7 are associated, as previously, two operating means 17, 18, respectively, constituted by two actuators or power cylinders for each interlinking member 5. Each actuator 17 has its cylinder 19 hingedly connected to the inner side of the associated side-beam 30 of the innermost section 3 whereas the free end of its rod 20 is hinged for example with one of the plates 32 of the associated interlinking member, the said rod passing between the two beams 30 and 31. Each actuator 18 has its cylinder 21 pivoted on the hinge pin 6, whereas the free end of its rod 22 is hingedly connected to the upper portion of the associated side-beam 9 of the outermost section 4.

The ramp innermost section 3 is provided at its rolling surface with a stop block 34 secured on the outer side of each beam 31 to receive the pin 33 of the associated interlinking member 5. To allow each pin 33 to be locked in the associated stop block 34, there is provided a catch or the like 35 hingedly mounted on the side beam 31 and actuated for example through the medium of the rod of an auxiliary actuator 36 whose cylinder is hingedly connected to the beam 31, and of a return spring 37.

The operation of such a ramp will now be described. In a first stage, as in the preceding form of embodiment, each of the first operating means 17 is actuated to cause the interlinking members 5 and the ramp outermost section 4 to pivot about the hinge pin 6. During this movement the pins 33 move nearer to the stop blocks 34 (FIG. 5). The action of first operating means 17 is stopped when the pins are received in the stop blocks. Simultaneously with this movement the auxiliary actuators 36 hold the catches 35 in a substantially raised position to allow free access to the blocks 34. When the pins 33 are received in the blocks 34 the action of the actuators 36 is released and the catches 35 under the action of the compressed return springs 37 ensure the locking or confinement of the pins 33 in the blocks 34.

Of course the auxiliary actuators 36 may be of the double-acting type allowing the return springs 37 to be dispensed with.

Thereafter the second operating means, namely the actuators 18, are operated as previously to cause the outermost section 4 of the ramp to pivot about the hinged joint 7 and assume a substantially aligned position in prolongation of the innermost section 3.

The refolding or retraction of the ramp is performed as in the first form of embodiment by operating the actuators 18 and then, before operating the actuators 19, the pins 33 of the intermediate interlinking members are unlocked by applying pressure to the intermediate actuators 36 which disengage the catches 35 from the stop blocks 34 thus allowing free passage of the pins 33.

It is important to note that in this second form of embodiment the blocks 34 do not only act as stop means, but also, in association with the catches 35 as means for locking the intermediate members 5 on the innermost section 3 of the ramp. So, when the first operating means, namely the actuators 17, have moved the pins 33 of the interlinking members 5 into their respective stop blocks and the catches 35 have been moved down, the interlinking members 5 are rigidly locked with the innermost section 3 of the ramp. On the contrary, in the first form of embodiment, only the actuators 17 hold the intermediate members 5 applied against the associated upper ends of the side beams 8.

Figure 6:
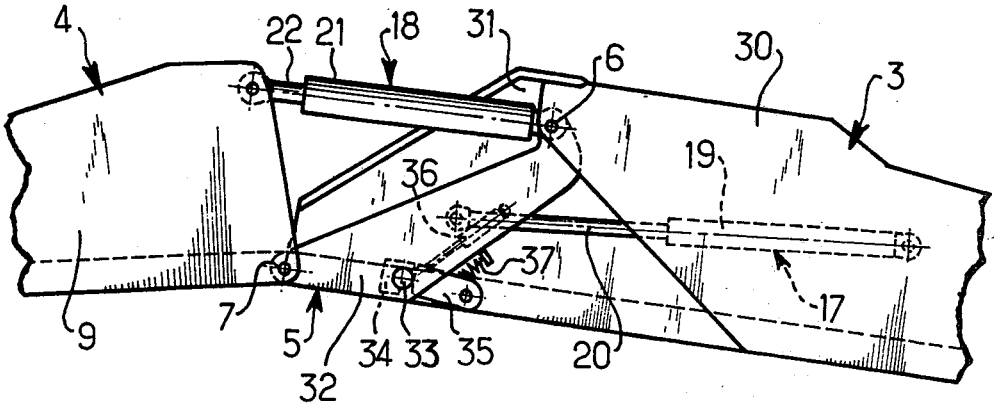
FIG. 6 is a view identical with that of FIG. 5, with the ramp in the completely extended position.

Furthermore, in the extended position shown in FIG. 6, it is not necessary to provide an auxiliary rolling platform 25 as in the first form of embodiment to ensure the connection between the two ramp sections, since the mutually confronting ends of the ramp sections are perfectly adjacent. This is due mainly to the fact that the hinged joints 6 in the second form of embodiment are shifted inwardly as compared with the first form of embodiment. Thus, the interlinking members 5 never project beyond the innermost section 3 as in the first form of embodiment.

The movable access ramp retracting and extending device according to the invention is of simple structure requiring but a minimum number of interconnecting and operating means between the ramp proper and the ship. Indeed, cables are necessary only between the ship and the first ramp section adjacent to the said ship. Moreover, the space requirement of the hydraulic or pneumatic operating means for the extension or unfolding of the outermost section of the ramp with respect to its innermost section and constituted for example by a group of two sets of main actuators is reduced to a minimum, they present no mounting problem and are readily accessible for repair purposes.

Such a device can be applied to any type of ramp comprising at least two main sections one of which is foldable onto the other, whatever the type of connection of the ramp with the ship.

Of course my invention is by no means limited to the form of embodiment described and illustrated by way of example only, but comprises all the technical equivalents of the means described if the latter are carried out and used within the scope of the following claims.

What is claimed is:

1. Apparatus for retracting and extending a movable, vertically pivoting, access ramp adapted to extend between, for example, a vehicle such as a floating vessel and a platform spaced from the vehicle such as a dock, said ramp being hoistable to an inoperative stowed position on the vehicle and lowerable to an operative or working position wherein it partially rests on said platform, the access ramp including at least a first inner ramp section having an inner end hingedly connected to the vehicle, means connected between the vehicle and the first ramp section for hoisting or lowering said section about said hinged connection, and a second outer ramp section pivotable about an inner end thereof for folding downwardly against and lengthwise of said first ramp section, wherein the retracting and extending apparatus comprises at least one intermediate linking member having spaced apart first and second hinge locations; a first hinge pin connecting the linking member at said first hinge location with the outer end of said first ramp section; a second hinge pin connecting the linking member at said second hinge location with the inner end of said second ramp section, the axes of the first and second hinge pins being substantially perpendicular to the longitudinal axis of the ramp; at least one first operating means attached to the linking member for rotating the linking member relative to the first ramp section about said first hinge pin; and at least one second operating means attached to the second ramp section for rotating the second ramp section relative to the linking member about said second hinge pin.

2. Apparatus according to claim 1 wherein the first operating means is connected between the linking member and the first ramp section and the second operating means is connected between the second ramp section and the linking member.

3. Apparatus according to claim 3 wherein the first operating means is arranged to pivot the linking member about the first hinge pin relative to the first ramp section independently of the actuation of said second operating means, whereby the second ramp section is pivotable about the first hinge pin in fixed relation to the linking member when the first operating means is actuated and the second operating means is fixed.

4. Apparatus according to claim 3 further comprising stop means mounted on one of the first ramp section and the linking member for contacting the other of the first ramp section and the linking member to limit the pivoting movement about the first hinge pin of the linking member relative to the first ramp section in response to actuation of the first operating means to extend said access ramp.

5. Apparatus according to claim 4 further comprising a locking member for rigidly locking the first ramp section and the linking member when the stop means contacts said other of the first ramp section and the linking member in the extended position.

6. Apparatus according to claim 5 wherein the locking member is pivotally attached to the first ramp section for movement between a first unlocking position and a second locking position.

7. Apparatus according to claim 3 wherein the second operating means is arranged to pivot the second ramp section about the second hinge pin relative to the linking member independently of the actuation of the first operating means, whereby said second ramp section is pivotable about the second hinge pin relative to the first ramp section and linking member when the second operating means is actuated and the first operating means is fixed.

8. Apparatus according to claim 1 wherein the first and second operating means are operable simultaneously to extend the second ramp section relative to the first ramp section.

9. Apparatus according to claim 1 wherein the first operating means comprises at least one hydraulic or pneumatic actuator or power cylinder connected to the inner ramp section and the linking member at locations spaced from the axis of the first hinge pin, and the second operating means comprises at least one hydraulic or pneumatic actuator or power cylinder connected to the linking member and the outer ramp section at locations spaced from the axis of the second hinge pin, the first operating means being adapted to pivot the linking member and the outer ramp section about the first hinge pin independently of the actuation of the second operating means.

10. Apparatus according to claim 9 wherein the second operating means is attached to the linking member at a point spaced from a line extending between the first and second hinge locations.

11. Apparatus according to claim 9 wherein the second operating means is attached to the linking member at the first hinge location.

12. Apparatus according to claim 1 wherein the first and second ramp sections have spaced side beams, and the at least one intermediate linking member comprises two linking members, each linking member being pivotally connected to corresponding side beams of the first and second ramp sections by respective first and second hinge pins.

* * * * *

UNITED STATES PATENT OFFICE

CERTIFICATE OF CORRECTION

Patent No. 4,142,640 Dated 6 March 1979

Inventor(s) Henri Kummerman

It is certified that error appears in the above-identified patent and that said Letters Patent are hereby corrected as shown below:

Column 7, line 30: change "3" to --2--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*